US008028760B2

(12) United States Patent
Yoshikane

(10) Patent No.: US 8,028,760 B2
(45) Date of Patent: Oct. 4, 2011

(54) HAMMER DRILL

(75) Inventor: Kiyonobu Yoshikane, Anjo (JP)

(73) Assignee: Makita Corporation, Anjo (JP)

( * ) Notice: Subject to any disclaimer, the term of this patent is extended or adjusted under 35 U.S.C. 154(b) by 291 days.

(21) Appl. No.: 12/320,816

(22) Filed: Feb. 5, 2009

(65) Prior Publication Data

US 2009/0223692 A1 Sep. 10, 2009

(30) Foreign Application Priority Data

Mar. 5, 2008 (JP) ..... 2008-055435

(51) Int. Cl.
*E02B 7/02* (2006.01)

(52) U.S. Cl. ..... 173/48; 173/104; 173/128

(58) Field of Classification Search ..... 173/133, 173/47, 48, 104, 102, 103, 117, 128
See application file for complete search history.

(56) References Cited

U.S. PATENT DOCUMENTS 6,035,945 A 3/2000 Ichijyou et al.
2002/0126209 A1 9/2002 Yamada et al.

FOREIGN PATENT DOCUMENTS

JP A-6-262413 9/1994
JP B2-3168363 3/2001

*Primary Examiner* — Paul Durand
(74) *Attorney, Agent, or Firm* — Oliff & Berridge, PLC

(57) ABSTRACT

The invention is to provide a hammer drill which is to be capable of restricting rotation of a bit in a hammer mode, and improve usability.

A hammer drill includes a lock plate 51 in a housing 2, and the lock plate 51 engages with a second gear 31 so as to lock rotation of the second gear. The lock plate 51 is provided to be slidable between an engaging position with the second gear 31 and a non-engaging position, and is biased to the engaging position by a coil spring. The hammer drill further includes a restriction part 50 on an outer peripheral side of a holding tube 46 in a mode switching knob 44. The restriction part 50 abuts the lock plate 51 in one of two phases for engaging a clutch 37 with only a boss sleeve 32 so as to hold the lock plate 51 at the non-engaging position, and cancels the abutment with the lock plate 51 in the other phase to slide the lock plate 51 to the engaging position. In a hammer mode, a user can select a state for making rotation of a tool holder 3 free in one phase or a state for restricting the rotation of the tool holder 3 in the other phase.

18 Claims, 16 Drawing Sheets

HAMMER DRILL

This application claims the benefit of Japanese Patent Application Numbers 2008-55435 which were filed on Mar. 5, 2008, the entirety of which is incorporated by reference.

BACKGROUND OF THE INVENTION

1. Field of the Invention

The present invention relates to a hammer drill capable of giving rotation and/or impact to a bit at a top end thereof.

2. Description of the Background Art

As shown, for example, in patent document 1, a hammer drill having the following structure has been known: a hammer drill includes a tool holder supported at a front part in a housing, an impact mechanism provided at a rear part of the housing, an intermediate spindle supported in parallel with the tool holder at a lower part of the impact mechanism. The tool holder holds a bit at a front end thereof, and the impact mechanism has a reciprocating impact piece for indirectly impacting the bit via an intermediate piece. A rotation of an output spindle of a motor is transmitted to the intermediate spindle, at which a clutch member, a second gear (a rotation transmitting member), a boss sleeve (an impact transmitting member) and a switching lever (a mode switching member) are provided. The clutch member has clutch pawls on both faces thereof and is capable of integrally rotating with the intermediate spindle and sliding in a spindle direction. The second gear is loosely fitted to the intermediate spindle at a front part of the clutch member, has a pawl for engaging with the clutch, and meshes with a gear at the tool holder side. The boss sleeve is loosely fitted to the intermediate spindle at a rear part of the clutch member, has a pawl for engaging with the clutch, and converts the rotation of the intermediate spindle to a fore and aft movement so as to transmit the movement to the impact mechanism. The switching lever has a pushing piece (an engaging pin) provided at an eccentric position thereof, where the pressing piece fits to a tapered face provided around the periphery of the clutch member.

That is, the clutch member is slid by an eccentric movement of the pressing piece by a rotating operation of the switching lever, so that the clutch member is engaged with and released from the second gear and/or the boss sleeve. As a result, a user can select one of modes of which a drill mode for engaging the clutch member with only the second gear to give only rotation to the bit, a hammer drill mode for engaging the clutch member with both the second gear and the boss sleeve to give rotation and impact to the bit, or a hammer mode for engaging the clutch member with only the boss sleeve to give only impact to the bit. As a result, the mode can be switched smoothly with a simple structure, and thus wear and heat generation of the member due to switching of the mode can be suppressed, and excellent durability can be acquired.

Patent document 1: Japanese patent No. 3168363

SUMMARY OF THE INVENTION

In such the hammer drill, when the hammer mode is selected, rotation of the second gear becomes free. Thus, the second gear may be rotated due to friction with the intermediate spindle, causing to rotate the tool holder and the bit. As a result, it impairs usability in an operation with a fixed direction of the bit, e.g., a chipping work.

An object of the present invention is to provide a hammer drill capable of restricting rotation of a bit in a hammer mode with a simple structure and improving usability, while maintaining an advantage of employing an engaging pin.

In order to achieve the above object, according to a first aspect of the present invention, there is provided a hammer drill including a tool holder, an impact mechanism, a motor, an intermediate spindle, a rotation transmitting member, an impact transmitting member, a clutch member, a mode switching member, and an engaging pin. The tool holder is rotatably supported at a front part in a housing and capable of mounting a bit at a front end thereof The impact mechanism is provided at a rear part of the tool holder and capable of impacting the bit. The motor is provided at a rear part in the housing, and the intermediate spindle being supported in parallel with the tool holder receives rotation transmitted from an output spindle of the motor. The rotation transmitting member is provided rotatably at a front part on the intermediate spindle as a separated body from the intermediate spindle and rotated so as to transmit rotation of the intermediate spindle to the tool holder side. The impact transmitting member is provided rotatably at a rear part on the intermediate spindle as a separated body from the intermediate spindle and is rotated so as to convert the rotation of the intermediate spindle to a fore and aft movement and transmit the movement to the impact mechanism. The clutch member is provided between the rotation transmitting member and the impact transmitting member to be capable of integrally rotating with the intermediate spindle, sliding in the fore and aft direction, and engaging with and releasing from the rotation transmitting member and/or the impact transmitting member depending on the sliding position. The mode switching member is provided in the housing to be capable of rotating operation. The engaging pin is provided at an eccentric position of the mode switching member to be capable of advancing and retreating with a predetermined stroke toward an outer periphery of the clutch member, and is biased toward an engaging position with the outer periphery of the clutch member by a biasing member.

In the hammer drill, the clutch member is slid via the engaging pin by rotating the mode switching member from an external of the housing. By sliding the clutch member, a user can select one of the modes of which a drill mode for engaging the clutch member with only the rotation transmitting member to rotate the tool holder, a hammer drill mode for engaging the clutch member with the rotation transmitting member and the impact transmitting member to rotate the tool holder and operating the impact mechanism, or a hammer mode for engaging the clutch member with only the impact transmitting member to operate only the impact mechanism.

The hammer drill further includes a lock member in the housing, which engages with the rotation transmitting member to be able to lock the rotation. The lock member is capable of sliding between an engaging position with the rotation transmitting member and a non-engaging position with the rotation transmitting member.

The hammer drill further includes a restriction part on an outer peripheral side of the engaging pin in the mode switching member. The restriction part slides the lock member to the non-engaging position in one of two phases of the engaging pin, which engages the clutch member with only the impact transmitting member, and slides the lock member to the engaging position in the other phase. By the restriction part, the hammer mode can be further selected from a state of making the rotation of the tool holder to be free at the position where the engaging pin is in one phase, and a state of restricting the rotation of the tool holder at the position where the engaging pin is in the other phase.

According to a second aspect of the present invention, in the structure according to the first aspect of the present invention, the lock member is biased toward the engaging position by a second biasing member in order to accurately switch the mode to the hammer mode which restricts the rotation of the tool holder. The lock member abuts to the restriction part in the one phase so as to restrict the slide toward the engaging position, and thereby the lock member is held at the non-engaging position. The lock member is allowed to slide to the engaging position by canceling the restriction of sliding by the restriction part in the other phase.

According a third aspect of the present invention, in the structure according the first and second aspects of the present invention, a V-shaped groove is formed on an outer periphery of the clutch member in order to improve reliability of the mode switching, and a top end of the engaging pin to engage with the groove is formed with a tapered shape. At a time of an rotation operation of the mode switching member between the hammer mode and the drill mode, where a rotation of the tool holder is restricted, in a case that the clutch member and the rotation transmitting member or the clutch member and the impact transmitting member are not engaged by abutting each end face of these members, the engaging pin retreats against a bias of the biasing member while sliding the top end of the engaging pin along the groove to bias the clutch member to the engaging position with other members. Further, in this non-engaging state, a stroke of the advancing/retreating movement of the engaging pin is set such that retreating of the engaging pin is restricted before the mode switching member reaches to a rotation operating position after switching the mode.

According to the first aspect of the present invention, the hammer mode can restrict the rotation of the bit while maintaining an advantage of employing the engaging pin, thereby improving usability. In addition, since the hammer drill has a simple structure with only adding the restriction part and the lock member, thereby minimizing the cost increase involving the addition of the rotating restriction.

According to the second aspect of the present invention, in addition to the first aspect, even in a case that the rotation transmitting member and the lock member are not engaged at the time of switching the mode to the hammer mode, when the rotation transmitting member is rotated, the lock member is engaged immediately with the rotation transmitting member by the second biasing member, and thus the mode can be accurately switched to the hammer mode for restricting the rotation of the tool holder.

According to the third aspect of the present invention, in addition to the first and the second aspects, a hammer drill does not run in a drill mode in a state where the lock member engages with the rotation transmitting member, thereby increasing a reliability of the mode switching.

BRIEF DESCRIPTION OF THE DRAWINGS

FIG. 2 is an external appearance view of an inside structure in which a housing is omitted, wherein

FIG. 6 is an external appearance view of an inside structure in which a housing is omitted, wherein

FIG. 10 is an external appearance view of an inside structure in which a housing is omitted, wherein

DESCRIPTION OF THE PREFERRED EMBODIMENTS

Figure 1:
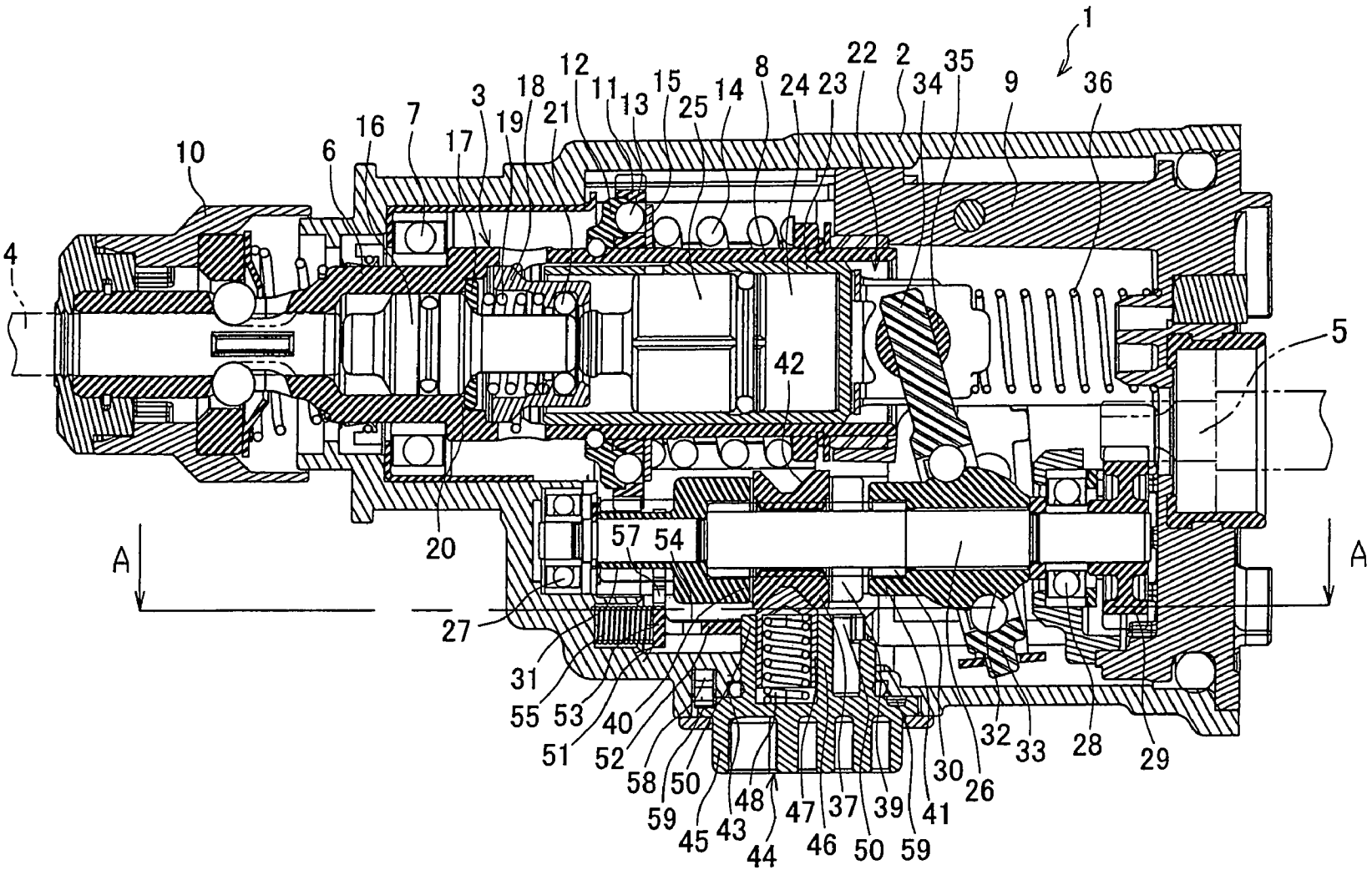
FIG. 1 is a partial longitudinal cross sectional view of a hammer drill (in a drill mode)

Preferred embodiments of the present invention will be described below referring to the drawings.

Figure 2A:
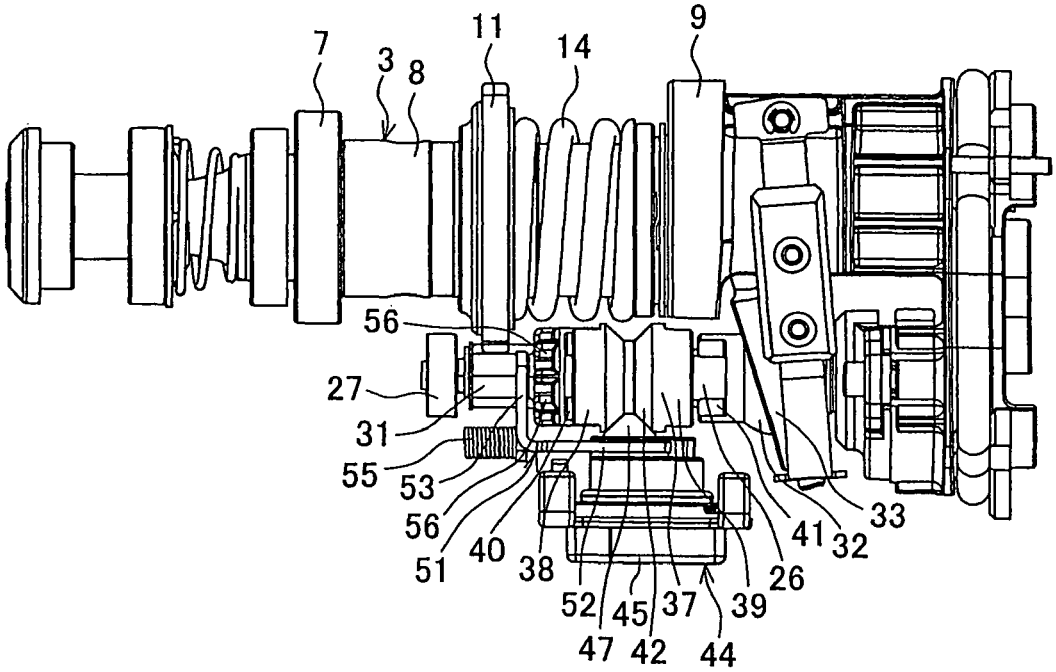
FIG. 2A illustrates a right lateral face.
Figure 2B:
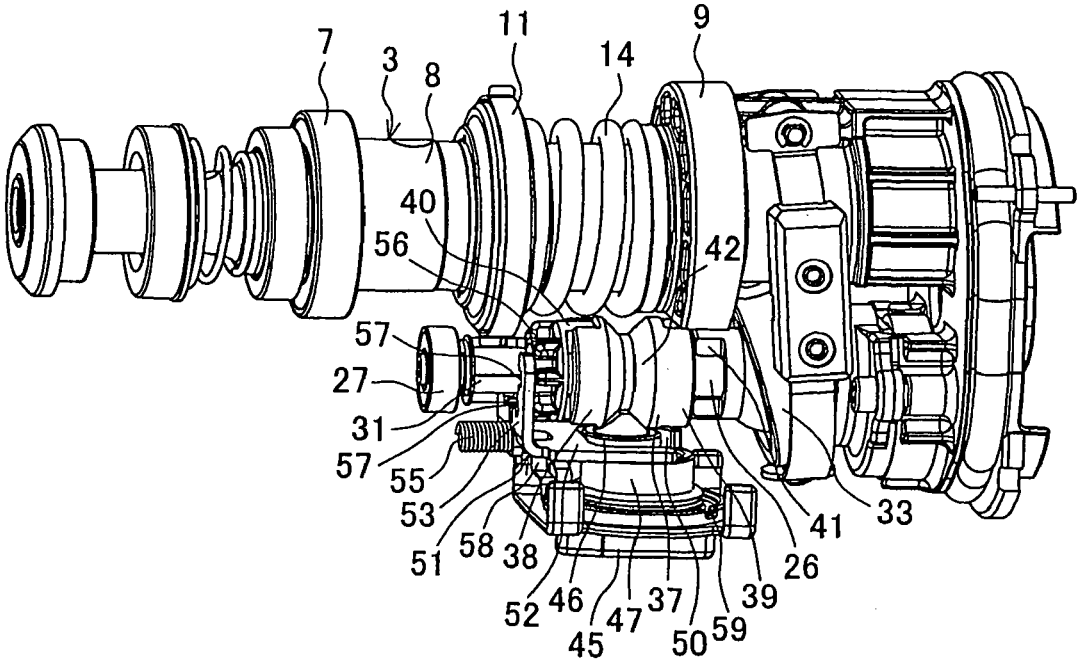
FIG. 2B is a perspective view.

FIG. 1 is a partial longitudinal cross sectional view to illustrate one example of a hammer drill. FIG. 2 is an external appearance view of an inside structure in which a housing is omitted. A hammer drill 1 includes a tool holder 3 rotatably supported at a front part of a housing 2 (on a left side of FIG. 1), and the tool holder 3 is capable of mounting a bit 4 at a front end thereof. The hammer drill 1 further includes a motor housed at a rear part of the housing 2, and the motor has an output spindle 5 directed frontward (only the output spindle 5 is illustrated in the drawings).

The tool holder 3 has a cylindrical body formed with an intermediate part 6 and a large diameter part 8, where the intermediate part 6 is rotatably supported by a ball bearing 7 at a front end of the housing 2. The large diameter part 8 is rotatably supported by an inner housing 9 mounted at a rear part in the housing 2. The tool holder 3 has an operation sleeve 10 for attaching and detaching the inserted bit 4 at a front end projecting from the housing 2.

Furthermore, a gear 11 is externally mounted on an outer periphery of the large diameter part 8. The gear 11 is positioned by abutting a stopper ring 12 which is fixedly, externally mounted on the front side of the large diameter part 8. Rotation of the gear is restricted by balls 13, being pushed toward the stopper ring 12 side via a washer 15 with a coil spring 14. The coil spring 14 is externally mounted on the large diameter part 8, and the balls are held with a predetermined interval in a peripheral direction and are in a state of fitting in a concave portion of the stopper ring 12. That is, when a load heavier than a biasing force of the coil spring 14 is applied to the gear 11, the balls 13 get over the concave portion of the stopper ring 12 and the gear 11 idly rotates. As a result, a torque limiter for intercepting rotation transmitted to the tool holder 3 is formed.

Further, an impact bolt 16, which is an intermediate piece positioned at a rear part of the bit 4, is housed fore and aft movably in the intermediate part 6 of the tool holder 3, and a receiving ring 17, which restricts a retreating position of the impact bolt 16, is provided in the large diameter 8 at a rear part of the intermediate part 6. The receiving ring 17 is pressed and fixed at a stepped part 20, which is between the intermediate part 6 and the large diameter part 8, by a coil spring 19 positioned between the receiving spring 17 and a cylindrical cap 18 mounted inside the large diameter part 8 at a rear part of the receiving spring 17. A rear end of the impact bolt 16 is fitted to a rear end of the cap 18 during a normal use. When the impact bolt 16 is idled, for example, in a case where the tool holder 3 does not have the bit 4, an O-ring 21 which holds a front end of a striker 25 described below and restricts reciprocation of the striker 25 is housed in the tool holder 3.

Further, an impact mechanism 22 is provided at a rear part of the large diameter part 8. The impact mechanism 22 includes a cylindrical piston cylinder 23 which opens a front part thereof and is loosely fitted to the large diameter part 8, and a striker 25 as a fore and aft movable impact piece housed in the piston cylinder 23 via an air chamber 24. The piston cylinder 23 reciprocating in the large diameter part 8 interlocks the striker 25 with an action of an air spring, allowing the rear end of the impact bolt 16 fitted to the O-ring 21 in the cap 18 to be impacted.

On the other hand, an intermediate spindle 26 is supported in parallel with the tool holder 3 and the output spindle 5 by front and rear ball bearings 27 and 28 at a lower part of the output spindle 6 in the housing 2. A first gear 29 provided at a rear end of the intermediate spindle 26 is meshed with the output spindle 5. A spline tooth 30 is formed at an intermediate portion of the intermediate spindle 26. A second gear 31 as a rotation transmitting member is externally mounted between the spline tooth 30 and the ball bearing 27 with being separately rotatable from the intermediate spindle 26, and is meshed with the gear 11 in the tool holder 3. Further, a boss sleeve 32 as an impact transmitting member is externally mounted between the spline tooth 30 and the ball bearing 28 to be rotatable as a separated body from the intermediate spindle 26. A swash bearing 33 having a tilted spindle line is rotatably and externally fitted to an outer periphery of the boss sleeve 32. An upper end of a connection arm 34 projecting to an upper part of the swash bearing 33 is rotatably held at a rear end of the piston cylinder 23 via a ball 35. Therefore, when the boss sleeve 32 is rotated, the swash bearing 33 moves the spindle line fore and aft in a tilting manner, oscillates the connection arm 34 fore and aft, and reciprocates the piston cylinder 23. In addition, a coil spring 36 for biasing the piston cylinder 23 to a frontward movement is provided between the piston cylinder 23 and the inner housing 9.

A sleeve-shaped clutch 37 as a clutch member is spline-joined to the spline tooth 30 of the intermediate spindle 26 so as to be capable of rotating integrally with the intermediate spindle 26 and sliding in a fore and aft direction. The clutch 37 has a clutch pawl 38 on a front face thereof, and the clutch pawl 38 is capable of engaging with an engaging pawl 40 provided on a rear face of the second gear 31. The clutch 37 has a clutch pawl 39 on a rear face thereof, and the clutch pawl 39 is capable of engaging with an engaging pawl 41 provided on a front face of the boss sleeve 32. The clutch 37 is capable of engaging with and releasing from one or both of the second gear 31 and the boss sleeve 32 depending on a fore and aft sliding position. That is, the clutch 37 engages with only the second gear 31 in an advancing position to integrate the second gear 31 with the intermediate spindle 26 in a rotating direction. The clutch 37 engages with only the boss sleeve 32 in a retreating position to integrate the boss sleeve 32 with the intermediate spindle 26 in a rotating direction. The clutch 37 engages with both the second gear 31 and the boss sleeve 32 in the intermediate position to integrate the second gear 31 and the boss sleeve 32 with the intermediate spindle 26 in the rotating direction. Further, the clutch 37 has a V-shaped fitting groove 42 provided on an outer periphery thereof.

A mode switching knob 44 as a mode switching member is rotatably fitted to the mounting hole 43 provided at a lower part of the housing 2. The mode switching knob 44 is disc shaped having a knob part 45 formed at a bottom face thereof. A cylindrical holding tube 46 is provided to stand at an eccentric position from a rotation center on a top face of the mode switching knob 44 on a housing 2 inner side. An engaging pin 47 is housed in the holding tube 46. The engaging pin 47 has a tapered shape which is notched symmetrically so that an upper end thereof is fitted to the fitting groove 42 of the clutch 37. The engaging pin 47 is upwardly projected and biased by a coil spring 48, which is a biasing member housed at a lower part of the clutch 37, to fit the tapered-shaped upper end with the fitting groove 42 of the clutch 37. Therefore, when the mode switching knob 44 is rotated, the engaging pin 47 eccentrically moves with the holding tube 46 while fitting to the clutch 37 together. Thus, the clutch 37 is moved fore and aft according to a fore and aft moving distance of the engaging pin 47.

Further, the mode switching knob 44 has a restriction tube 49 standing on the top face thereof, and the restriction tube 49 has a concentric circle with a rotation center. One part of the restriction tube 49 has a circular restriction part 50, which has the same height as that of the holding tube 46 and is continuously formed with a peripheral wall of the holding tube 46. The rest of the restriction tube 49 is formed around a periphery while having a lower height by one step to be connected with an intermediate portion of the holding tube 46. Therefore, a phase of the restriction part 50 is changed according to rotation of the mode switching knob 44.

A lock plate 51 is provided at a lower part of the housing 2 and at a front part of the mode switching knob 44, and has a L shape in a side view. The lock plate 51 includes a U-shaped lower plate 52 having an opening directed backward in a fore and aft direction, and a U-shaped front plate 53 which is formed by upwardly bending a front end of the lower plate 52 and has an opening directed upward. Edges on both sides of the lower plate 52 are fitted to guiding grooves 54 formed on right and left inner faces of the housing 2. The lock plate 51 is held, fore and aft slidably, at positions where it interferes with the holding tube 46 and the restriction part 50 of the restriction tube 49. The lock plate 51 is biased by a coil spring 55 as a second biasing member provided on a frontward inner face of the housing 2 toward a position at which the holding tube 46 or the restriction part 50 is contacted with an U-shaped inner edge of the lower plate 52. On the other hand, the front plate 53 has notches 57, 57 and . . . at a U-shaped inner edge thereof, and these notches are fitted to a lock tooth 56 radially formed at a rear part of the second gear 31.

Figure 3:
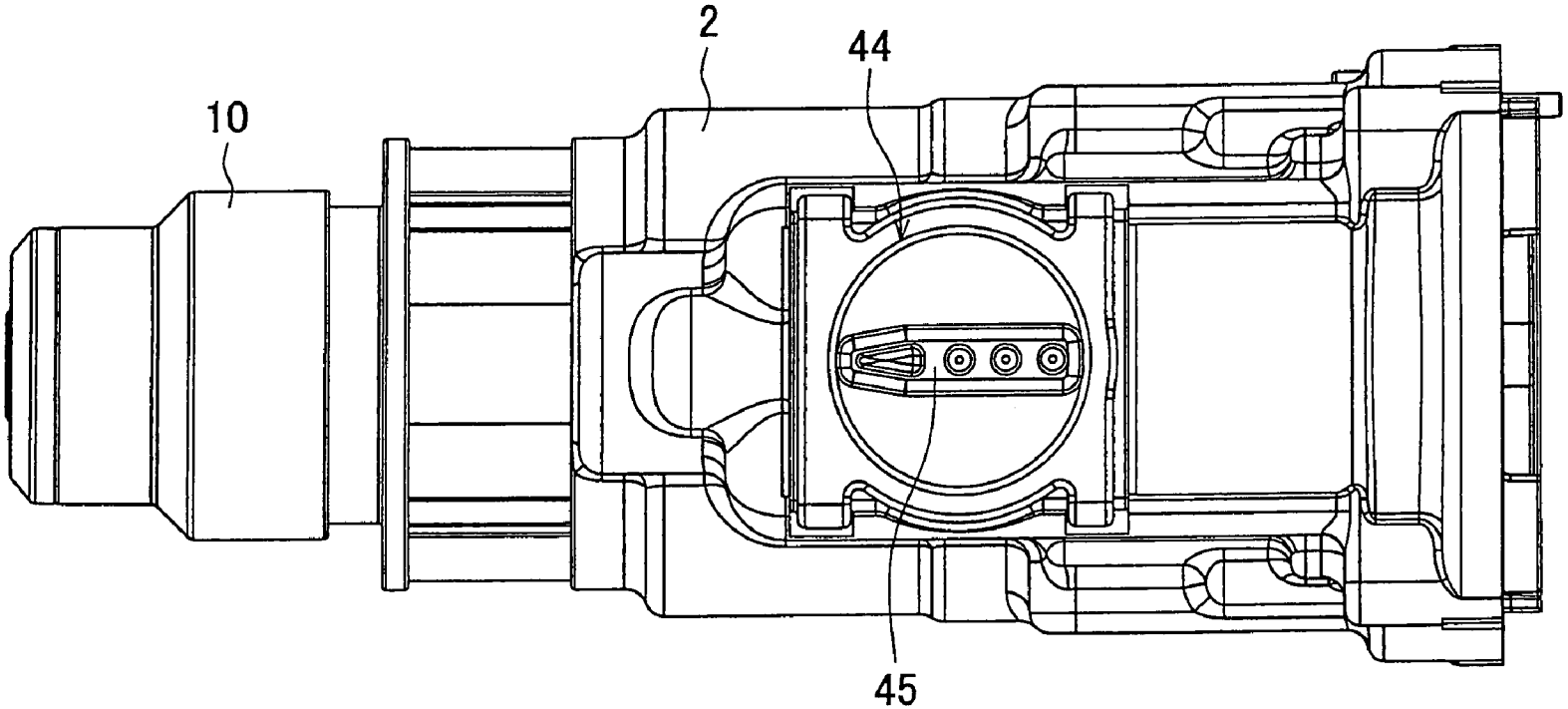
FIG. 3 is a bottom face view of a hammer drill.
Figure 4A:
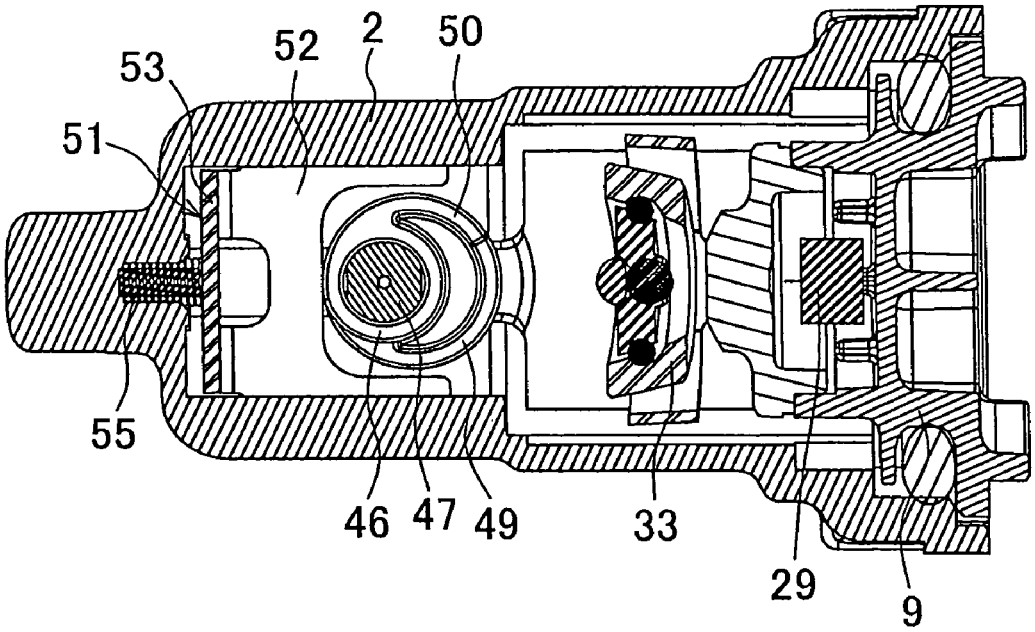
FIG. 4A is a cross sectional view taken along a line A-A.
Figure 4B:
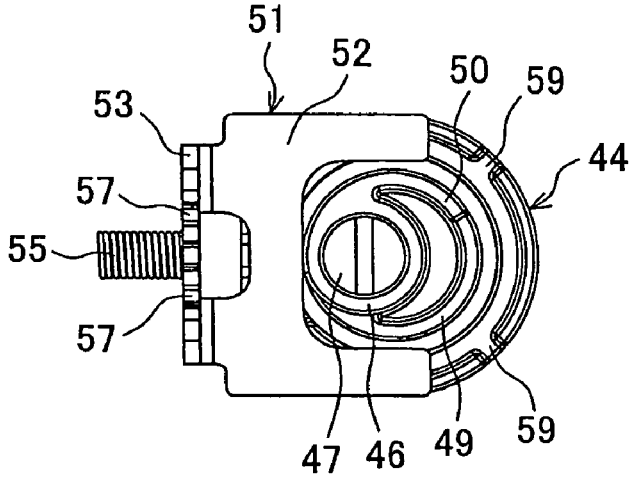
FIG. 4B is a plane view of a mode switching knob and a lock plate.

In the hammer drill 1 having the above-described structure, in a case that the mode switching knob 44 having the knob part 45 directed frontward is at a rotating operational position of FIGS. 1, 2 and 3, the holding tube 46 and the engaging pin 47 are positioned at the farthest front side as illustrated in FIG. 4. Thus, a mode becomes a drill mode in which the clutch 37 to be engaged with the engaging pin 47 is slid to the advancing position to engage the clutch pawl 38 on the front face side of the clutch 37 with the engaging pawl 40 of the second gear 31. In the drill mode, the lock plate 51 moves to an advancing position (the non-engaging position) with the holding tube 46 against a bias of the coil spring 55, and is restricted to slide at a position where the front plate 53 is not fitted to a lock tooth 56 of the second gear 31.

In the mode switching operation, the clutch pawl 38 and the engaging pawl 40 may not be meshed so that they are in a non-engaging state in which the both end faces are just contacted. However, in this case, the engaging pin 47 moves down against a bias of the coil spring 48 while sliding the top end of the engaging pin 47 along the fitting groove 42 of the clutch 37 so as to follow the movement of the holding tube 46. Therefore, a frontward biasing force is applied to the clutch 37 via the engaging pin 47. When the clutch 37 is rotated due to the rotation of the intermediate spindle 26 to come to a position at which the clutch pawl 38 and the engaging pawl 40 are meshed each other, the clutch 37 slides to the advancing position to connect with the second gear 31, as well as the engaging pin 47 moves up to fit again in the engaging groove 42.

In this drill mode, when the motor is driven after mounting the bit 4 on the tool holder 3, the intermediate spindle 26 is rotated and the rotation is transmitted to the tool holder 3 via the clutch 37, the second gear 31, and the gear 11 to rotate the bit 4. On the other hand, since the rotation is not transmitted to the boss sleeve 32 because of a distance from the advanced clutch 37, the piston cylinder 23 is not reciprocated, and thus the bit 4 performs only the rotation.

Figure 5:
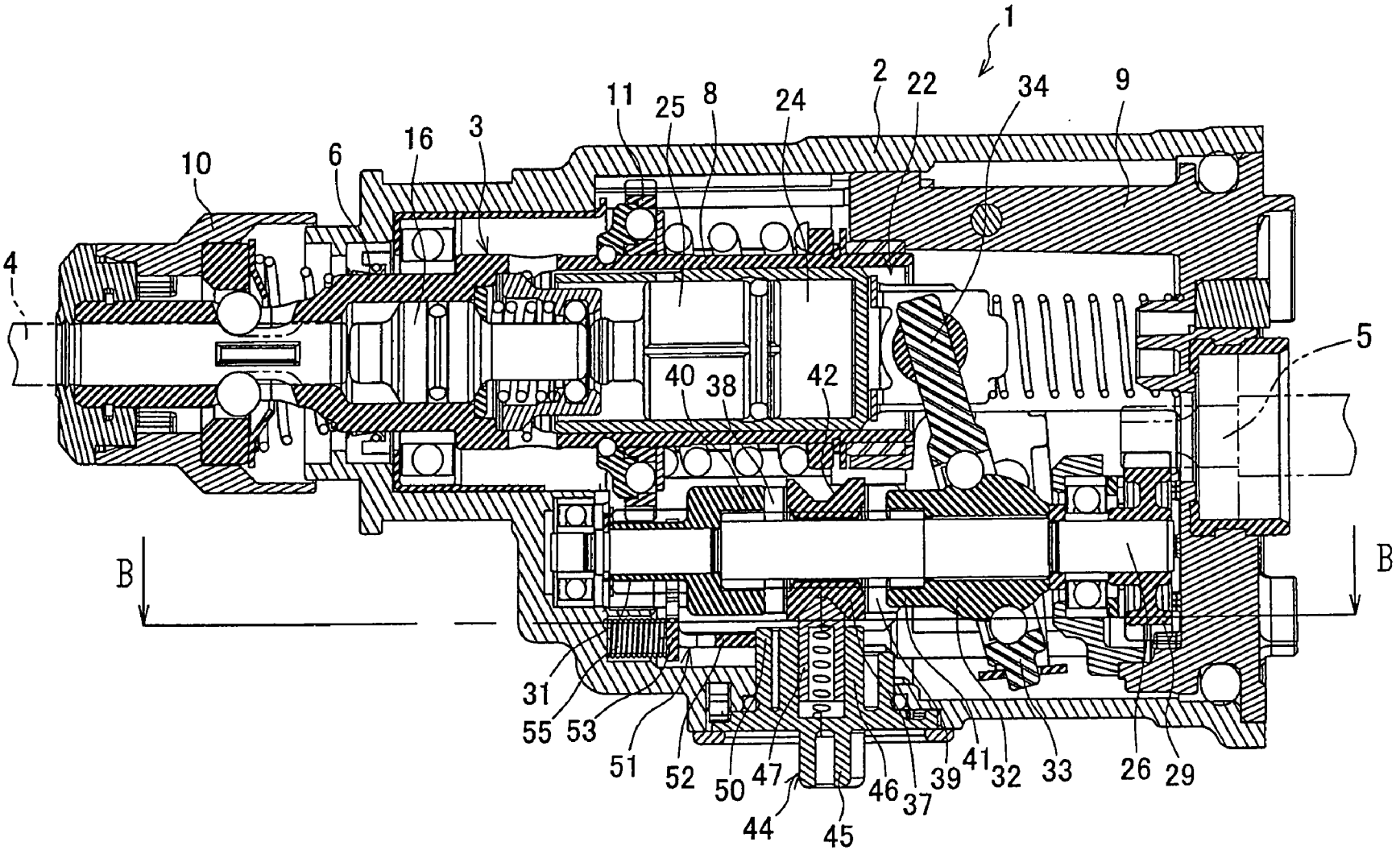
FIG. 5 is a partial longitudinal cross sectional view of a hammer drill (in a hammer drill mode)
Figure 6A:
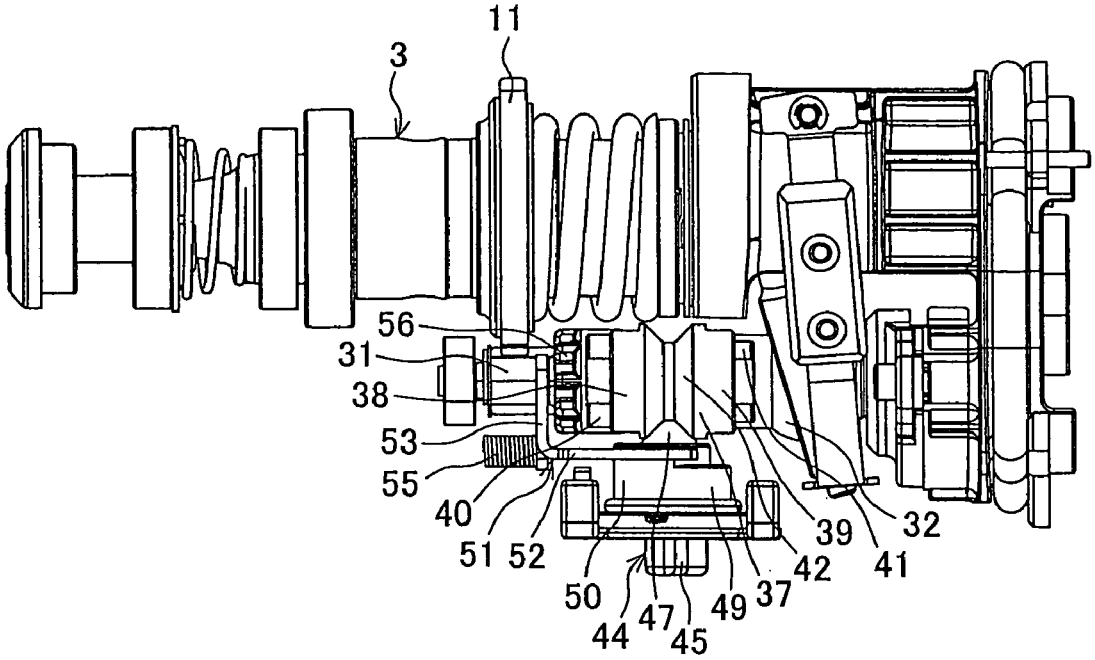
FIG. 6A illustrates a right lateral face.
Figure 6B:
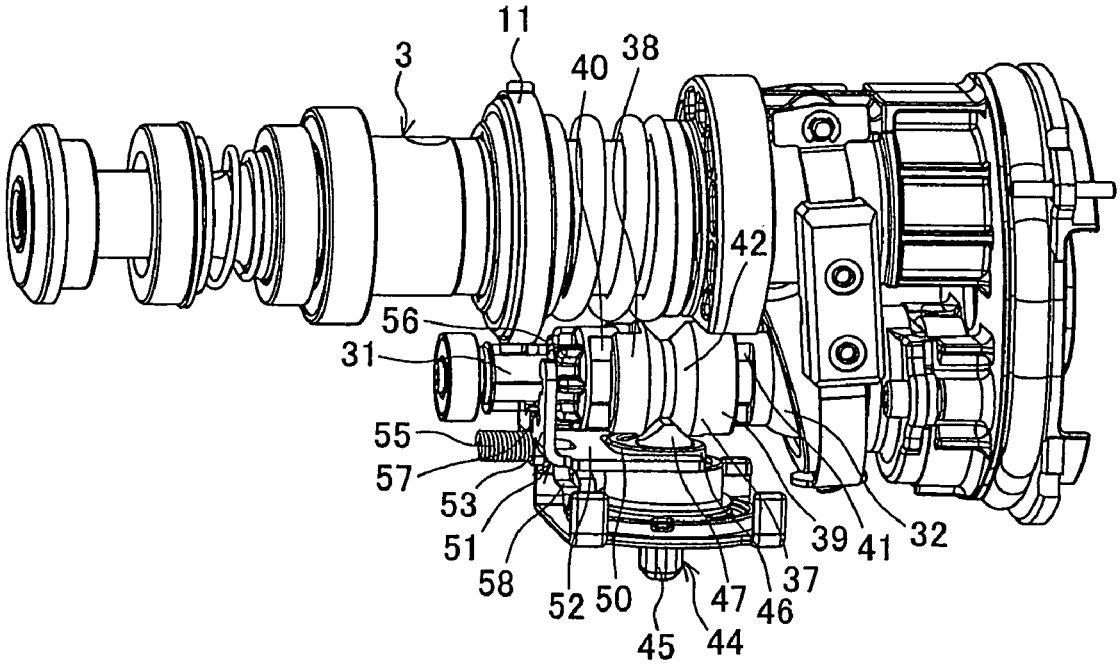
FIG. 6B is a perspective view.
Figure 7:
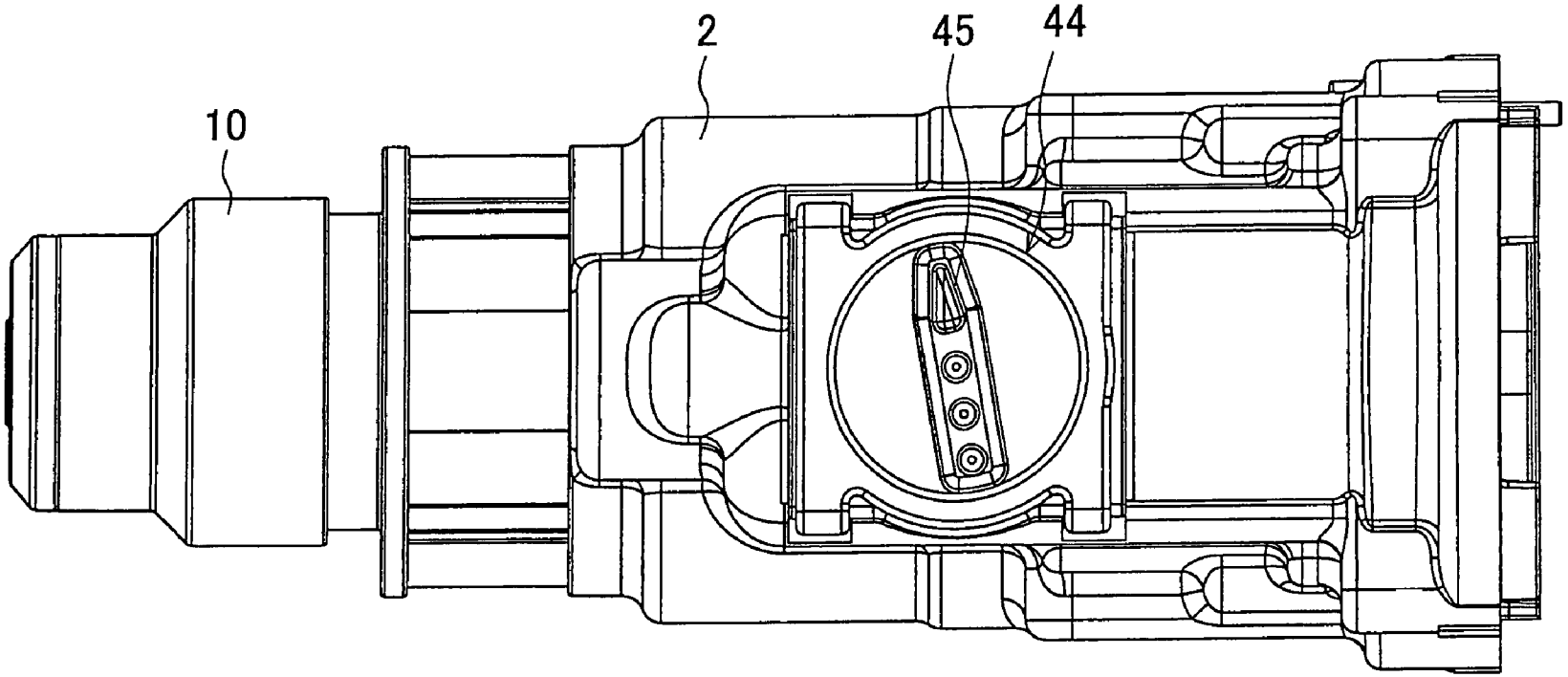
FIG. 7 is a bottom face view of a hammer drill.
Figure 8A:
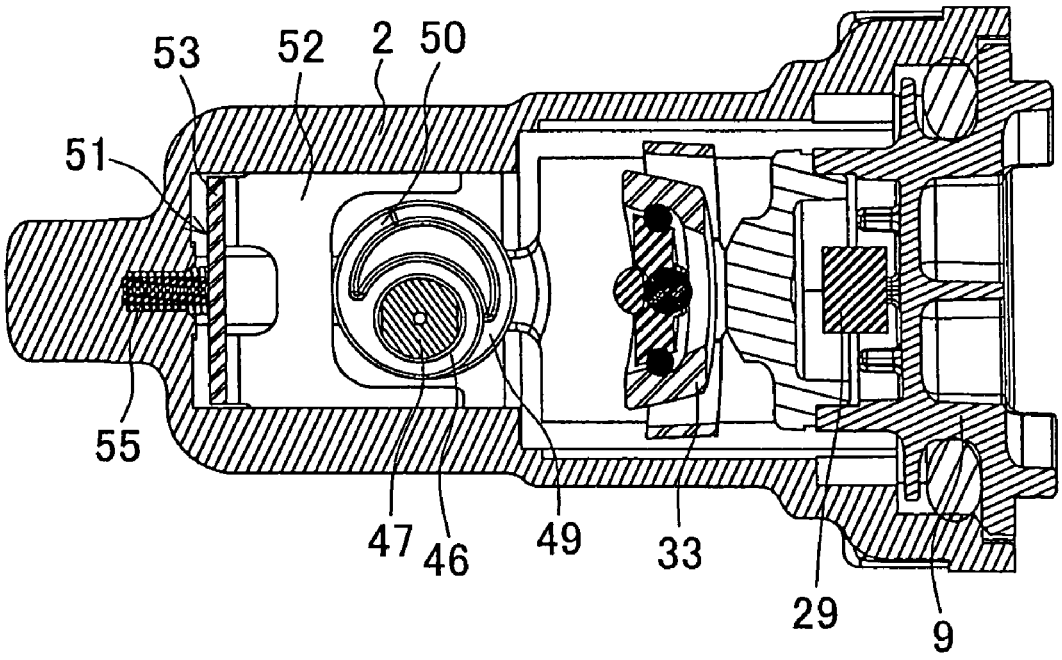
FIG. 8A is a cross sectional view taken along a line B-B.
Figure 8B:
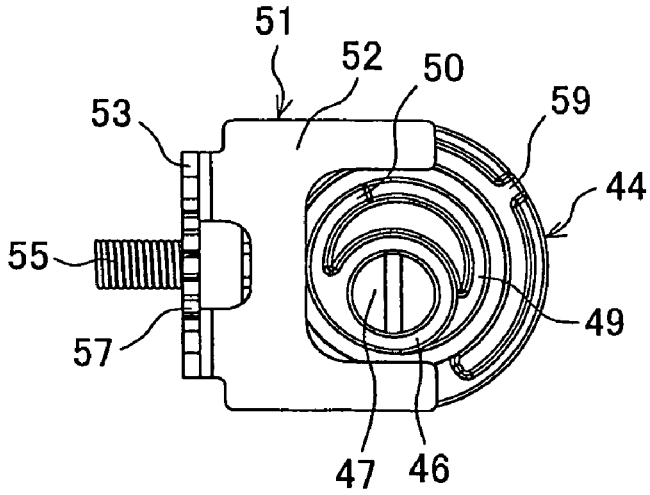
FIG. 8B is a plane view of a mode switching knob and a lock plate.

Then, as illustrated in FIGS. 5 to 7, in a case that the mode switching knob 44 is rotated clockwise by approximately 90° when viewed from a lower side so as to make the knob part 45 to be directed substantially sideways, the holding tube 46 and the engaging pin 47 are also rotated clockwise to be moved toward a lateral position as illustrated in FIG. 8. Thus, the clutch 37 is slid to an intermediate position via the engaging pin 47. Therefore, a mode is switched to a hammer drill mode in which the clutch pawl 39 on a rear face side of the clutch 37 engages with the engaging pawl 41 of the boss sleeve 32 while keeping the clutch 37 connected with the second gear 31. At this time, because the restriction part 50 restricts sliding of the lock plate 51 by shifting a phase to directly abut with an inner edge of the lower plate 52, even when the holding tube 46 is moved, the lock plate 51 is still at the non-engaging position.

In addition, even when the clutch 37 and the boss sleeve 32 are not engaged, like the case that the clutch 37 and the second gear 31 are engaged, the engaging pin 47 moves down so as to press the coil spring 48, and the clutch 37 is biased backward. Therefore, when the clutch 37 is rotated to have a position at which the both pawls are meshed each other, the clutch 37 retreats to immediately connect with the boss sleeve 32.

When the motor is driven in the hammer drill mode, the rotation of the intermediate spindle 26 is transmitted to the tool holder 3 via the clutch 37, the second gear 31 and the gear 11 to rotate the bit 4, and the rotation is also transmitted to the boss sleeve 32 connected with the clutch 37. Therefore, the swash bearing 33 is oscillated, and the connection arm 34 reciprocates the piston cylinder 23. By this operation, the striker 25 in the piston cylinder 23 is interlocked to reciprocate so as to impact the impact bolt 16 abutting with the rear end of the bit 4. Therefore, the impact is transmitted to the bit 4 in addition to the rotation.

Figure 9:
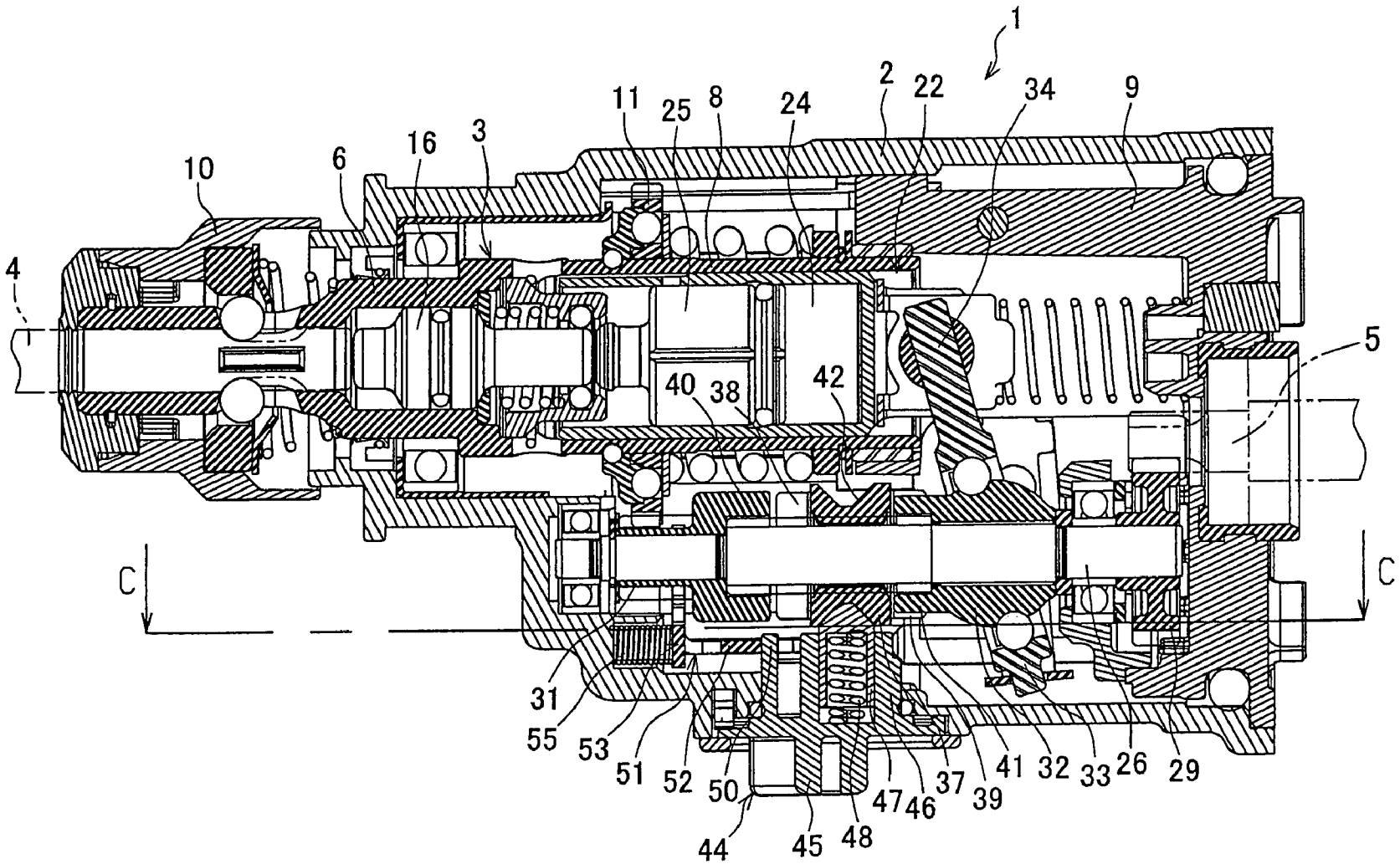
FIG. 9 is a partial longitudinal cross sectional view of a hammer drill (in a neutral mode)
Figure 10A:
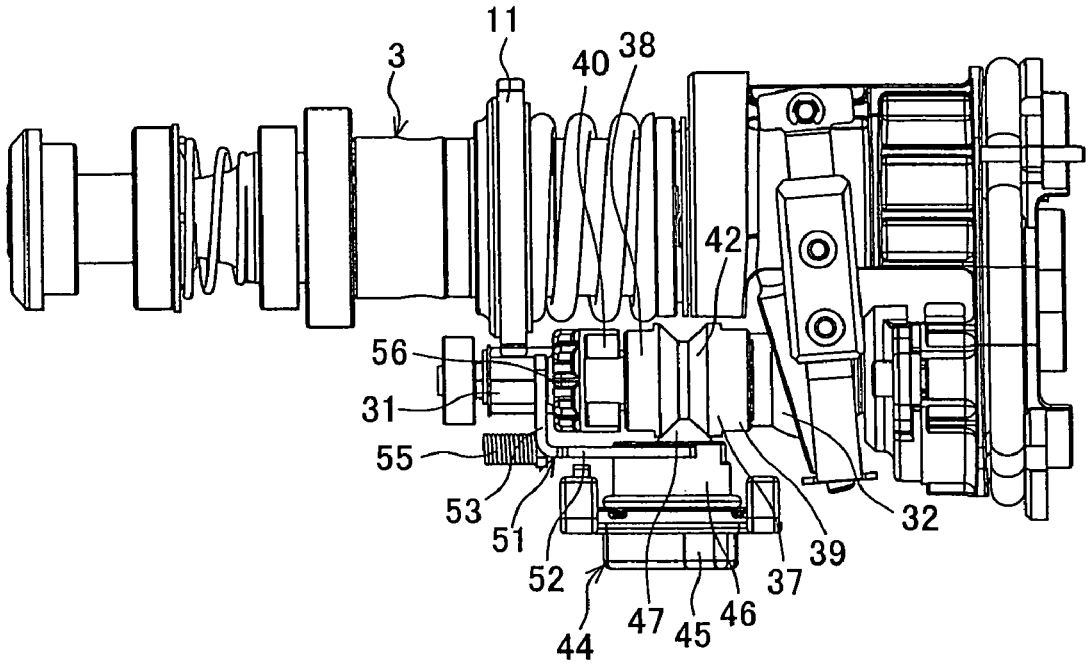
FIG. 10A illustrates a right lateral face.
Figure 10B:
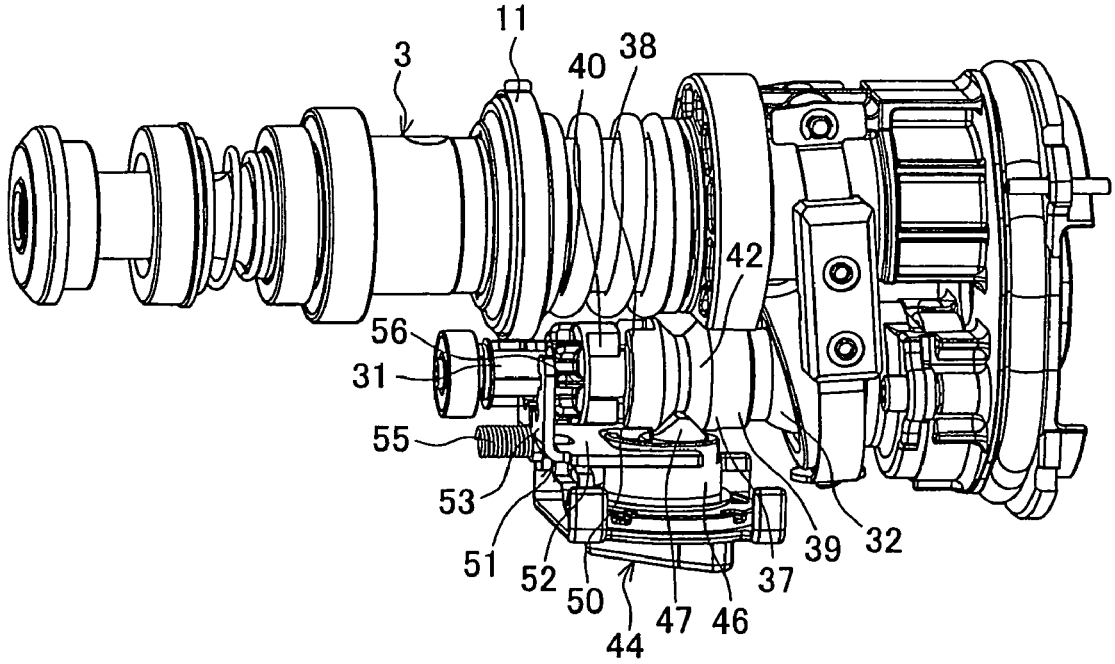
FIG. 10B is a perspective view.
Figure 11:
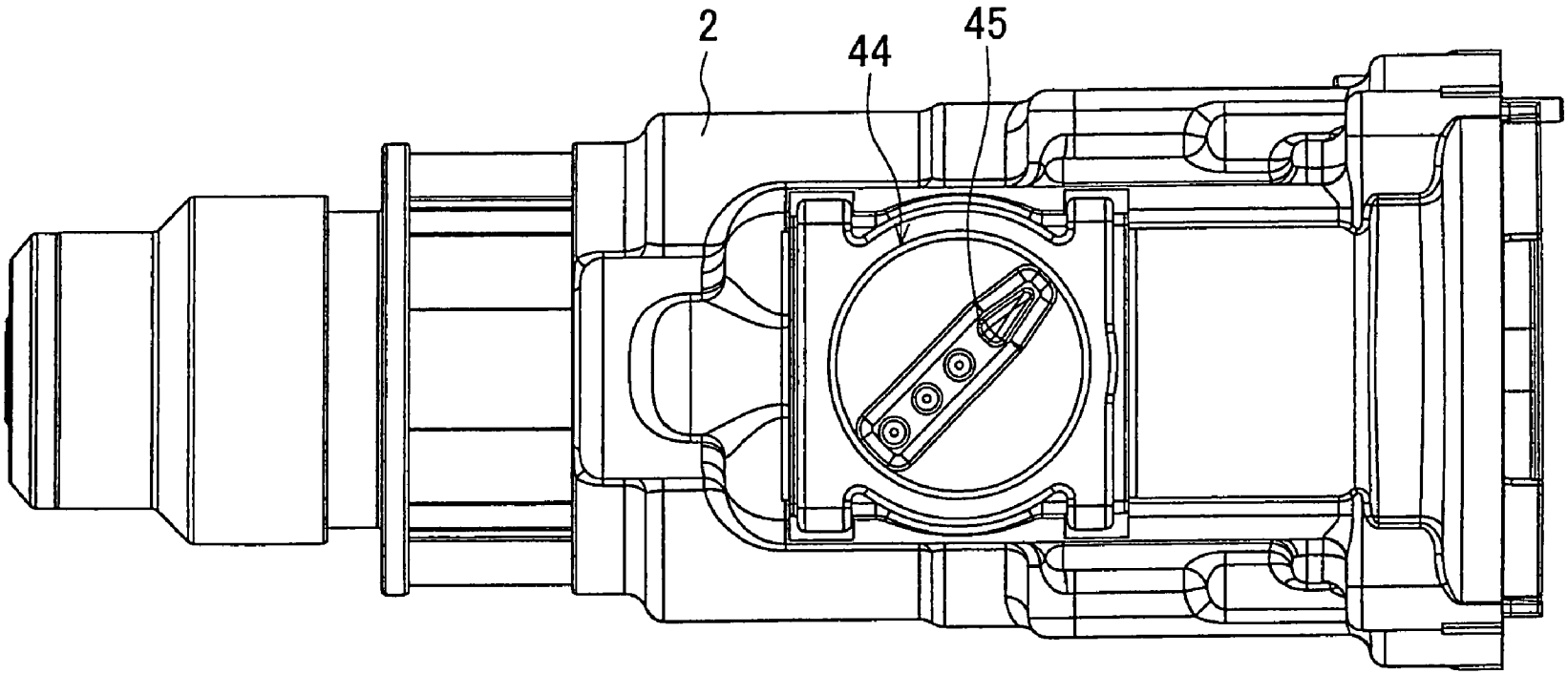
FIG. 11 is a bottom face view of a hammer drill.
Figure 12A:
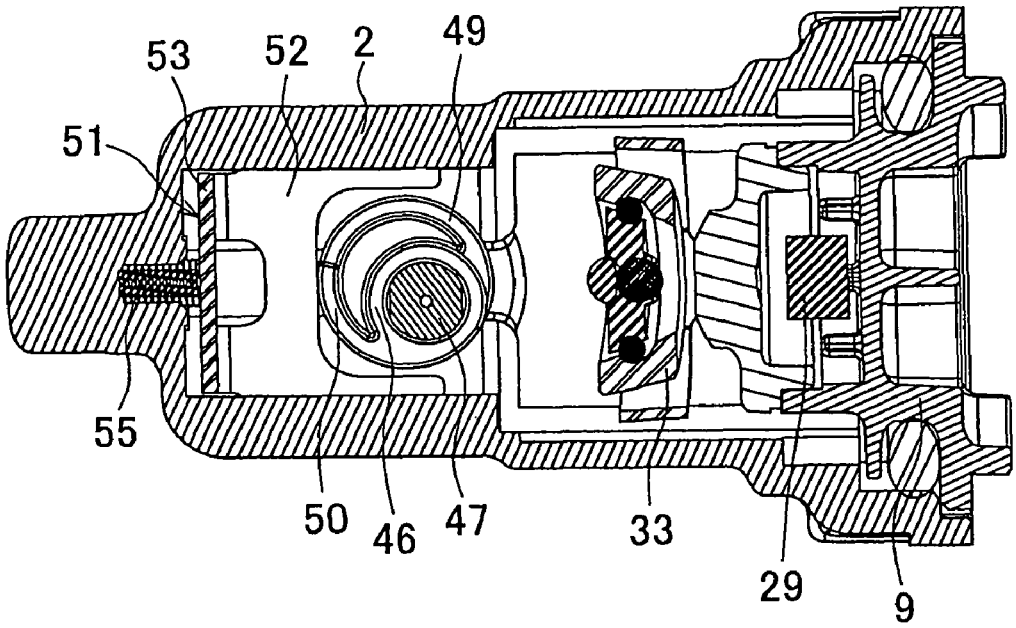
FIG. 12A is a cross sectional view taken along a line C-C.
Figure 12B:
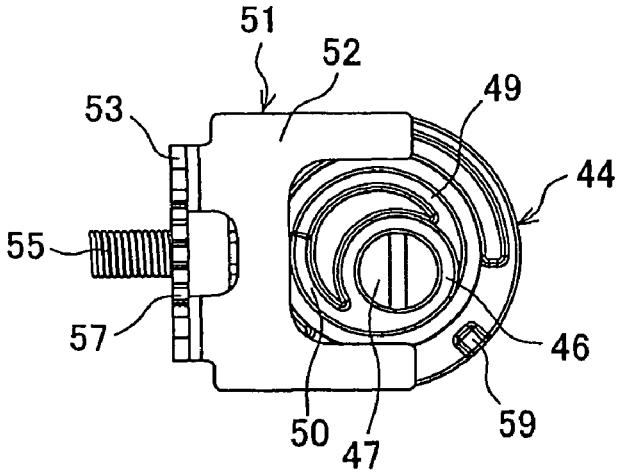
FIG. 12B is a plane view of a mode switching knob and a lock plate.

Then, as illustrated in FIGS. 9 to 11, in a case where the mode switching knob 44 is further rotated clockwise by approximately 45°, the holding tube 46 and the engaging pin 47 are also rotated clockwise to move toward a rear side. Thus, the clutch 37 slides to a retreating position via the engaging pin 47 to separate from the second gear 31 as illustrated in FIG. 12, and then a mode is switched to a hammer mode (a neutral mode) in which the clutch 37 is engaged with only the boss sleeve 32. In this mode, even when the holding tube 46 is moved, the restriction part 50 shifts the phase to directly abut to the inner edge of the lower plate 52 so as to restrict sliding of the lock plate 51. Thus, the lock plate 51 is still at the non-engaging position.

When the motor is driven in this state, the rotation of the intermediate spindle 26 is not transmitted to the second gear 31, and thus the tool holder 3 is not rotated. By contrast, the boss sleeve 32 is rotated to reciprocate the piston cylinder 23, and thus only the impact is transmitted to the bit 4. However, since the rotation of the second gear 31 is not locked, the rotation of the tool holder 3 becomes free, and therefore an angle around a spindle line of the bit 4 can be changed arbitrarily.

Figure 13:
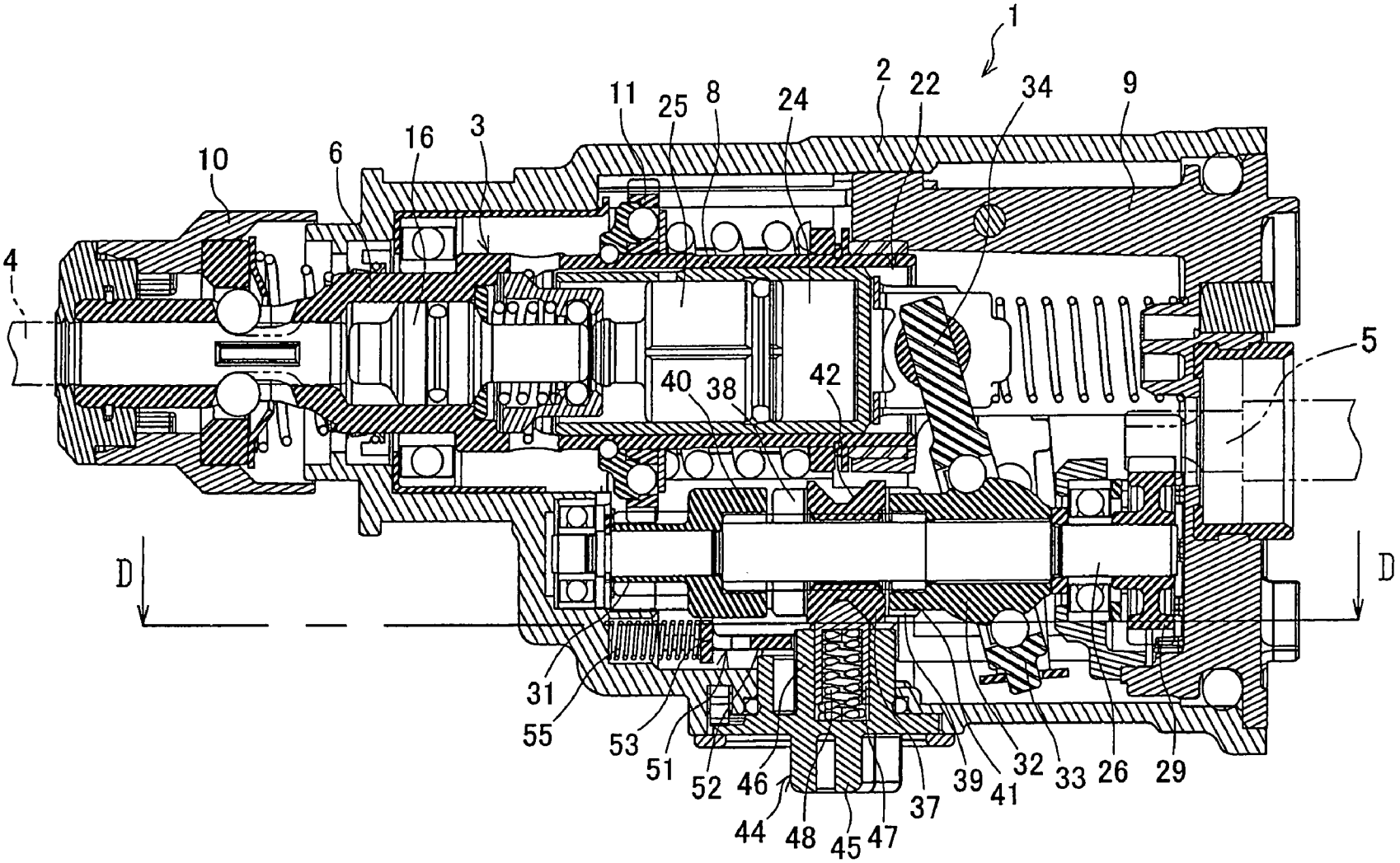
FIG. 13 is a partial longitudinal cross sectional view of a hammer drill (in a hammer mode)
Figure 14A:
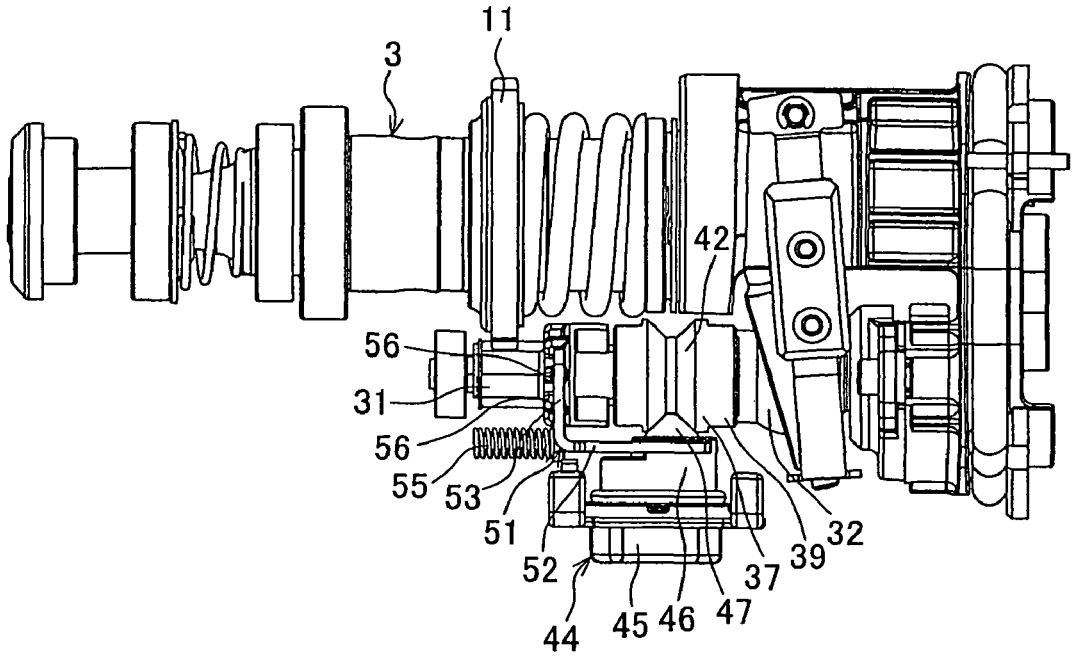
FIG. 14 is an external appearance view of an inside structure in which a housing is omitted, wherein FIG. 14 A illustrates a right lateral face, and FIG. 14 B is a perspective view.
Figure 14B:
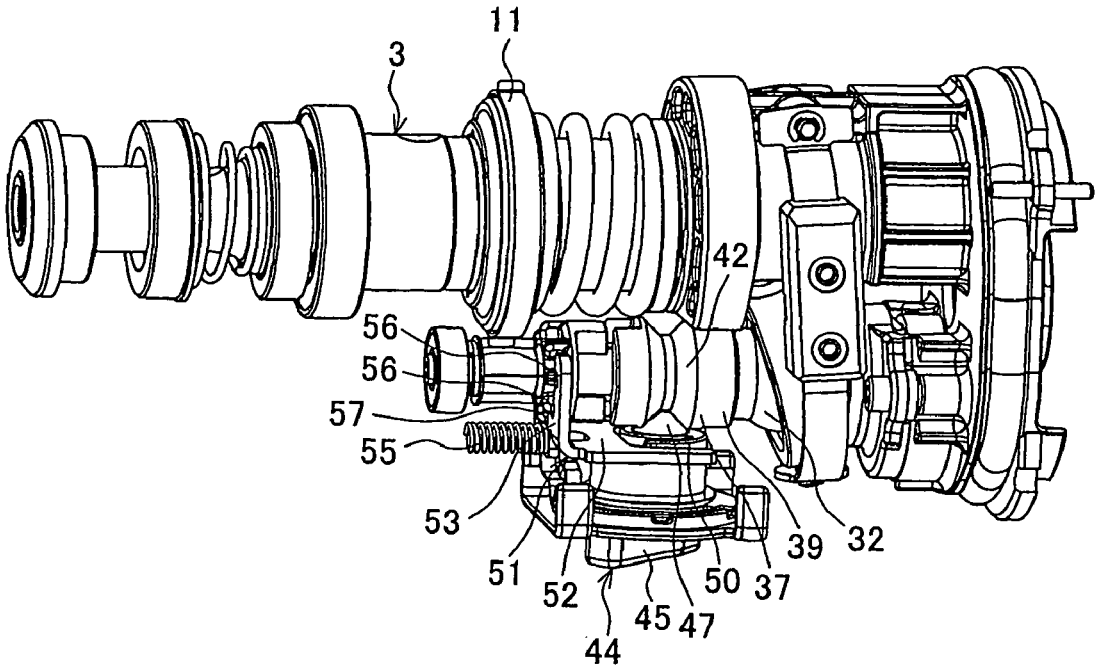
Figure 15:
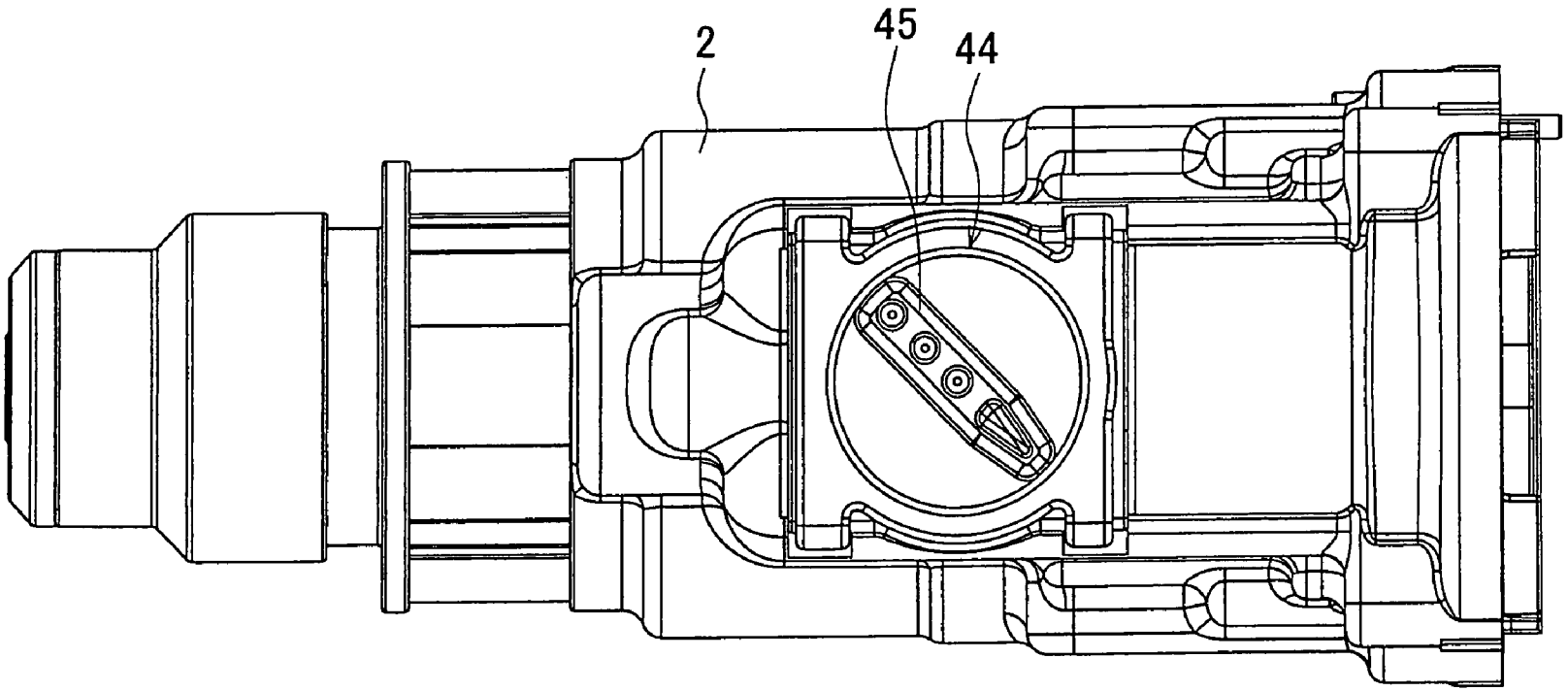
FIG. 15 a bottom face view of a hammer drill.
Figure 16A:
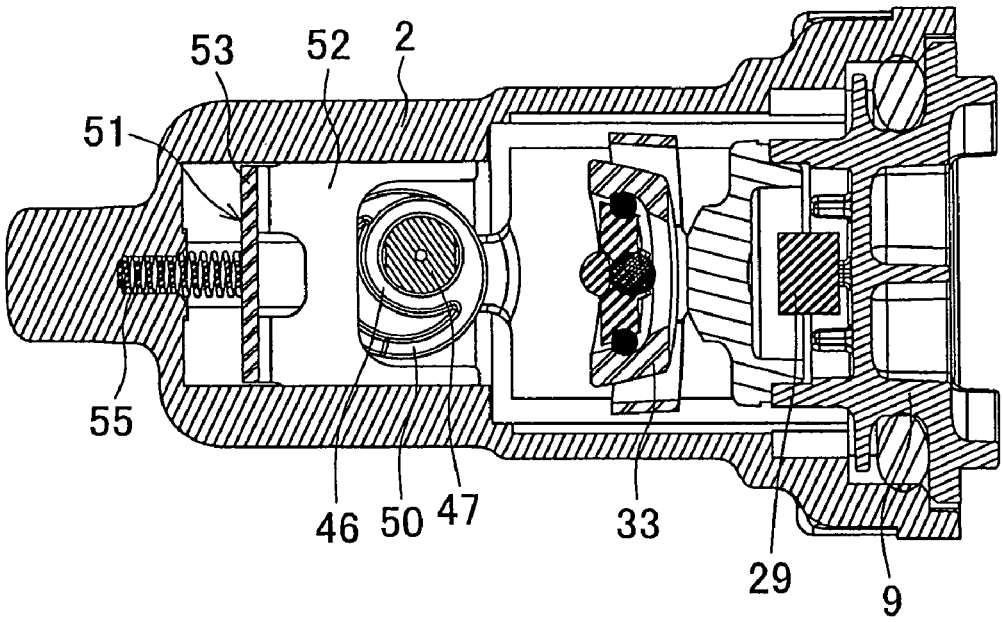
FIG. 16A is a cross sectional view taken along a line D-D.
Figure 16B:
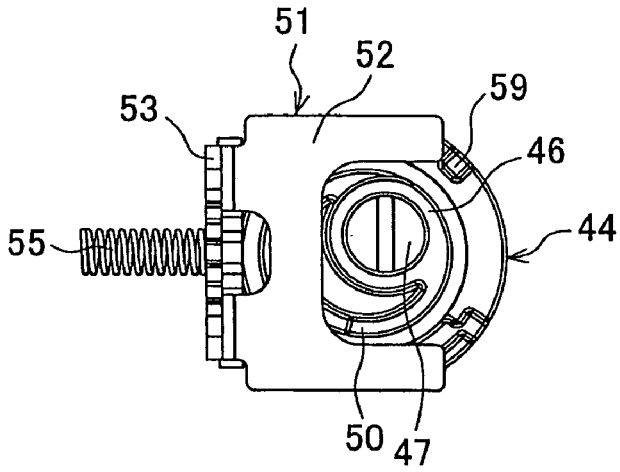
FIG. 16B is a plane view of a mode switching knob and a lock plate.

Then, as illustrated in FIGS. 13 to 15, when the mode switching knob 44 is further rotated clockwise by approximately 90°, the holding tube 46 and the engaging pin 47 are also rotated clockwise. However, as illustrated in FIG. 16, in the neutral mode the phase is to be line-symmetrically located with respect to a fore and aft straight line passing through the rotation center of the mode switching knob 44, and the fore and aft position is not changed. Thus, a mode is switched to a hammer mode in which the clutch 37 continues to mesh with the boss sleeve 32 at the retreating position and separated from the second gear 31. However, the restriction part 50 shifts the phase to move to the position further back than the holding tube 46. Thus, the lock plate 51 retreats until the inner edge of the lower plate 52 abuts with the holding tube 46 and is located at the engaging position where each notch 57 of the front plate 53 is fitted to the lock tooth 56 of the second gear 31. At this time, even when the phases of the each notch 57 and the lock tooth 56 does not meet, pressing to the lock tooth 56 by the coil spring 55 is continued. Therefore, the notch 57 is fitted to the lock tooth 56 to immediately lock the rotation when the phases meet by the rotation of the second gear 31.

When the motor is driven in this state, the rotation of the intermediate spindle 26 is not transmitted to the second gear 31, and also the tool holder 3 is not rotated. However, since the boss sleeve 32 is rotated to reciprocate the piston cylinder 23, only the impact is transmitted to the bit 4. Further, the rotation of the tool holder 3 is locked, so that an angle of the bit 4 is fixed.

In addition, in the housing 2, as illustrated in FIGS. 1 and 2 etc., a leaf spring 58 is held horizontally at the front part of the mode switching knob 44, and notch parts 59, 59, . . . are formed at a peripheral edge of the mode switching knob 44. The leaf spring 58 elastically locks the notches 59, 59, . . . corresponding to a rotation position of each operation mode described above. Thus, when the mode switching knob 44 is in the rotating operation, a click action can be obtained so as to allow the rotating operation to each operation mode to be done easily.

Further, in the present embodiment, the hammer mode can be directly switched to the drill mode by the rotating operation of the mode switching knob 44. However, in a case where the clutch pawl 38 of the clutch 37 is not engaged with the engaging pawl 40 of the second gear 31, the stroke of the engaging pin 47 is set such that a rotation movement to the position after switching the mode switching knob 44 is restricted by abutting the lower end of the engaging pin 47 to a bottom face of the holding tube 46 even if the engaging pin 47 moves down along the fitting groove 42 of the clutch 37. This setting is to prevent the hammer drill from running in the drill mode with the front plate 53 of the lock plate 51 fitting with the lock tooth 56 of the second gear 31.

According to the hammer drill 1 of this embodiment, due to the following structure, usability can be improved while maintaining the advantage of employing the engaging pin 47 and enabling to restrict the rotation of the bit 4 in the hammer mode: in the housing 2, the lock plate 51 engaged with the mode switching knob 44 for locking the rotation of the mode switching knob 44 is slidably provided between the engaging position with the second gear 31 and the non-engaging position with the second gear 31. On the other hand, the restriction part 50 is provided on the outer peripheral side of the engaging pin 47 in the mode switching knob 44. The restriction part 50 slides the lock plate 51 to the non-engaging position in one of the two phases of the engaging pin 47 which is for engaging the clutch 37 with only the boss sleeve 32, and slides the lock plate 51 to the engaging position in the other phase. By taking this structure, in the hammer mode, a user can further select an operation state from two states, that is, a state that the rotation of the tool holder 3 is free at a position where the engaging pin 47 is in the one phase, and a state that the rotation of the tool holder 3 is restricted at a position where the engaging pin 47 is in the other phase. In addition, the structure can be simplified in that only the restriction part 50 and the lock plate 51 are added. Thus, the cost increase due to adding of parts for restricting rotation can be suppressed to the minimum.

Particularly, in the present embodiment, according to a structure in which the lock plate 51 is provided to be biased to the engaging position by the coil spring 55, t the non-engaging position is held in one phase by abutting the lock plate 51 with the restriction part 50 to restrict sliding to the engaging position, while the sliding to the engaging position is allowed in the other phase by cancelling the sliding restriction by the restriction part 50. As a result, even in the state of which the lock tooth 56 of the second gear 31 is not meshed with the front plate 53 of the lock plate 51 and when the mode is switched to the hammer mode, the front plate 53 of the lock plate 51 is immediately engaged with the lock tooth 56 with the bias of the coil spring 55 after the second gear 31 being rotated, and thus, the mode can be switched to the hammer mode accurately.

Further, according to a following structure, it can be prevented the drill mode from operating with the lock plate 51 engaging with the second gear 31, and thus a reliability of the mode switching can be increased: the V-shaped fitting groove 42 is formed on an outer periphery of the clutch 37, and a top end of the engaging pin 47 to be engaged with the fitting groove 42 is formed to have a tapered shape. At a time of rotating the mode switching knob 44 between the hammer mode for restricting the rotation of the tool holder 3 and the drill mode, when the second gear 31 and the clutch 37 or the boss sleeve 32 and the clutch 37 are not engaged but abutted to each other on their both end faces, the engaging pin 47 retreats against the bias of the coil spring 48 while sliding the end of the engaging pin 47 along the fitting groove 42, and then the clutch 37 is biased to the engaging position with the opposite member. In addition, when the second gear 31 and the boss sleeve 32 are not engaged, the advancing and retreating stroke of the engaging pin 47 is set such that the retreating is restricted before the mode switching knob 44 reaches to the rotating operational position after the mode being switched.

In addition, in the above-described embodiment, the restriction part is provided at a part of the restriction tube, but only a wall-shaped restriction part can be provided. Further, it is not necessary to continuously form the restriction part with the holding tube, but the holding tube and the restriction part can be provided separately. Of course, the restriction part can also be formed to have other shapes, such as a pin-shaped projection shape, in addition to a circular wall shape.

On the other hand, the lock member is not limited to the lock plate in the above-described embodiment. The shape of the lower plate and the front plate can be changed, and the second biasing member can be changed to a pulling spring for pulling and biasing the lock plate from the rear side. Further, for example, the engaging position and the non-engaging position can be changed with locating the lock tooth of the second gear on the front end side, providing a through hole at the lower plate, in which the holding tube and the restriction part are loosely inserted, to bias the lock member frontward, resulting in that the front part becomes the engaging position and the rear part becomes the non-engaging position.

Further, an upper end of the engaging pin is symmetrically tapered in the above-described embodiment, but can be conically tapered.

In addition, in the above-described embodiment, the mode switching knob is provided at a lower part of the intermediate spindle, and the engaging pin is engaged with the clutch member. However, the mode switching knob can be provided on the side of the intermediate spindle (the side of the housing).

Furthermore, the impact mechanism can have a form in which a piston is reciprocated in a fixed cylinder to interlock the impact piece, or the intermediate piece is omitted so as to directly impact the bit by the impact piece. Therefore, the structure of the hammer drill can be properly changed in addition to the above-described embodiment.

What is claimed is:

1. A hammer drill comprising:

a tool holder being supported rotatably at a front part in a housing and capable of mounting a bit on a front end thereof;

an impact mechanism configured to impact the bit provided at a rear part of the tool holder;

a motor provided at a rear part in the housing;

an intermediate spindle configured to receive rotation from an output spindle of the motor and being supported in parallel with the tool holder;

a rotation transmitting member being rotatably provided at a front part of the intermediate spindle as a separated body, and configured to transmit a rotation of the intermediate spindle to a tool holder side;

an impact transmitting member being rotatably provided at a rear part of the intermediate spindle as a separated body, and configured to convert the rotation of the intermediate spindle to a fore and aft movement so as to transmit the movement to the impact mechanism;

a clutch member being provided between the rotation transmitting member and the impact transmitting member, being integrally rotatable with the intermediate spindle, being slidable in the fore and aft direction, and being capable of engaging with and releasing from the rotation transmitting member or the impact transmitting member or both, depending on a sliding position;

a mode switching member being provided at the housing and capable of rotationally operating;

an engaging pin being provided at an eccentric position of the mode switching member, capable of advancing and retreating with a predetermined stroke toward an outer periphery of the clutch member, and being biased to an engaging position with the outer periphery of clutch member by a biasing member, wherein:

an operation mode of the hammer drill is configured to be selected from:

a drill mode for engaging the clutch member with only the rotation transmitting member and rotating the tool holder;

a hammer drill mode for engaging the clutch member with the rotation transmitting member and the impact transmitting member, and rotating the tool holder and operating the impact mechanism; and a hammer mode for engaging the clutch member with only the impact transmitting member and operating only the impact mechanism, by rotating the mode switching member from an external of the housing so as to slide the clutch member via the engaging pin;

a lock member configured to engage with the rotation transmitting member and capable of locking the rotation of the rotation transmitting member and being provided slidably between an engaging position with the rotation transmitting member and a non-engaging position with the rotation transmitting member in the housing; and a restriction part being provided on an outer peripheral side of the engaging pin in the mode switching member, wherein:

the restriction part is configured to slide the lock member to the non-engaging position in one of two phases of the engaging pin for engaging the clutch member with only the impact transmitting member, and configured to slide the lock member to the engaging position in the other phase, and the hammer mode can be further selected from a state for making the rotation of the tool holder to be free at a position where the engaging pin is in one phase, and a state for restricting a rotation of the tool holder at a position where the engaging pin is in the other phase.

2. The hammer drill according to claim 1, wherein:

the lock member is biased to the engaging position by a second biasing member, wherein the lock member:

is held at the non-engaging position in one phase by abutting with the restriction part so as to restrict to slide to the engaging position; and is allowed to slide to the engaging position in the other phase by cancelling the sliding restriction by the restriction part.

3. The hammer drill according to claim 2, further including a V-shaped groove formed on the outer periphery of the clutch member; and an end of the engaging pin engaging with the groove is formed to have a tapered shape, wherein:

in a case that the clutch member and the rotation transmitting member or the clutch member and the impact transmitting member are not engaged but both end faces are abutted, when a rotating operation of the mode switching member between the hammer mode for restricting a rotation of the tool holder and the drill mode, the engaging pin retreats against the bias of the biasing member while sliding the end of the engaging pin along the groove, so that the clutch member is biased to the engaging position with the opposite member, and an advancing and retreating stroke of the engaging pin is set such that the retreating of the engaging pin is restricted before the mode switching member reaches to a rotating operational position after a mode switching in a case that the clutch member and the rotation transmitting member or the impact transmitting member are not engaged.

4. The hammer drill according to claim 2, wherein:

the second biasing member is a coil spring.

5. The hammer drill according to claim 2, wherein:

the lock member is formed to have a L-shaped plate member comprising an U-shaped lower plate and a front plate; and the lock member is biased by the second biasing member to make the U-shaped inner edge of the lower plate of the lock member be abutted to the holding tube or the restriction part.

6. The hammer drill according to claim 5, wherein:

both edges of the lower plate of the lock member are fitted to a guiding groove formed on right and left inner faces of the housing; and the lock member is held to be slidable fore and aft at a position being interfered with the holding tube and the restriction part of the restriction tube.

7. The hammer drill according to claim 5, wherein:

the rotation transmitting member is a gear; and a notch is formed at the U-shaped inner edge of the front plate and fitted to a lock tooth formed on the gear at the engaging position.

8. The hammer drill according to claim 7, further including:

a torque limiter is provided between the gear and the tool holder, the torque limiter making the gear idly rotate according to a predetermined load to the tool holder, and intercepting rotation transmitting to the tool holder.

9. The hammer drill according to claim 1, further including:

a V-shaped groove formed on the outer periphery of the clutch member; and an end of the engaging pin engaging with the groove is formed to have a tapered shape, wherein:

in a case that the clutch member and the rotation transmitting member or the clutch member and the impact transmitting member are not engaged but both end faces are abutted, when a rotating operation of the mode switching member between the hammer mode for restricting a rotation of the tool holder and the drill mode, the engaging pin retreats against the bias of the biasing member while sliding the end of the engaging pin along the groove, so that the clutch member is biased to the engaging position with the rotation transmitting member or the impact transmitting member, and an advancing and retreating stroke of the engaging pin is set such that the retreating of the engaging pin is restricted before the mode switching member reaches to a rotating operational position after a mode switching in a case that the clutch member and the rotation transmitting member or the impact transmitting member are not engaged.

10. The hammer drill according to claim 1, wherein:

the mode switching member is formed to be disk shaped and provided at a mounting hole formed at the housing;

a cylindrical holding tube is provided to stand at an eccentric position from a rotation center on an inner side of the housing; and the engaging pin is housed in the holding tube.

11. The hammer drill according to claim 10, further including:

a restriction tube being homocentric with the rotation center is provided to stand on an inner side of the housing of the mode switching member; and a part of the restriction tube is formed as an circular restriction part having a same height as that of the holding tube and being continuously formed with a peripheral wall of the holding tube, wherein:

the rest of the restriction tube has a lower height than that of the restriction tube.

12. The hammer drill according to claim 1, further including:

a leaf spring held in the housing; and a notch part formed for elastically engaging the leaf spring corresponding to a rotating position of the each mode, in the mode switching member.

13. The hammer drill according to claim 1, wherein:

the impact transmitting member is made to be a boss sleeve externally mounted on the intermediate spindle and rotatably provided on an outer periphery with a swash bearing having a connection arm radially projecting with a spindle line in a tilting manner.

14. The hammer drill according to claim 13, wherein:

the impact mechanism comprises:

a cylindrical piston cylinder loosely inserted into the tool holder and connected with the connection arm at a rear end of the piston cylinder; and a striker, fore-and-aft movably housed in the piston cylinder through an air chamber.

15. The hammer drill according to claim 14, further comprising a coil spring configured to bias the piston cylinder to advance frontward is provided between the piston cylinder and an inner face of the housing.

16. The hammer drill according to claim 14, further comprising:

an impact bolt provided between the bit and the striker in the tool holder, the impact bolt transmitting the impact by the striker to the bit.

17. The hammer drill according to claim 16, further including an O-ring provided between the striker and the impact bolt in the tool holder, the O-ring being fitted with a rear end of the impact bolt during normal use and holding a front end of the striker to restrict the reciprocation of the striker in a case that the impact is idle, for example, the tool holder does not have the bit.

18. The hammer drill according to claim 1, wherein:

the biasing member is a coil spring.

* * * * *